US005735209A

United States Patent [19]

Achelpohl

[11] Patent Number: 5,735,209

[45] Date of Patent: Apr. 7, 1998

[54] DOCTOR BLADE UNIT FOR THE INKING SYSTEM OF A ROTARY PRINTING PRESS

[75] Inventor: Fritz Achelpohl, Lienen, Germany

[73] Assignee: Windmöller & Hölscher, Lengerich/Westf., Germany

[21] Appl. No.: 714,861

[22] Filed: Sep. 17, 1996

[30] Foreign Application Priority Data

Sep. 28, 1995 [DE] Germany ..... 195 36 268.3

[51] Int. Cl.[6] ..... B41F 1/46

[52] U.S. Cl. ..... 101/363; 101/366

[58] Field of Search ..... 101/364, 366, 101/363, 116, 350

[56] References Cited

U.S. PATENT DOCUMENTS

| | | | |
|---|---|---|---|
| 3,339,485 | 9/1967 | Rytterholm | 101/363 |
| 4,958,561 | 9/1990 | Grosshauser et al. | 101/366 |
| 5,085,144 | 2/1992 | Lindstrom et al. | 101/366 |
| 5,410,961 | 5/1995 | DeNicola et al. | 101/366 |
| 5,497,702 | 3/1996 | Gorter | 101/366 |
| 5,520,110 | 5/1996 | Tittgemeyer | 101/363 |

FOREIGN PATENT DOCUMENTS

| | | |
|---|---|---|
| 2344573 | 8/1978 | Germany . |
| 3911839 | 10/1990 | Germany . |

*Primary Examiner*—Edgar S. Burr
*Assistant Examiner*—Daniel J. Colilla
*Attorney, Agent, or Firm*—Evenson, McKeown, Edwards & Lenahan, PLLC

[57] ABSTRACT

A doctor blade unit for the inking system of a rotary printing press includes a doctor blade carrier that is formed by a profiled rail with a channel-shaped recess. The doctor blade carrier is provided with two doctor blades that can be screwed to the carrier and moved down on an ink application roller as well as sealing elements at its ends. The face walls on the ends of the ink chamber which carry the sealing elements are provided with holes for accommodating a pipe that is provided with spaced apart holes that form spraying nozzles over its entire length. One end of the pipe is provided with a connection for supplying cleaning fluid.

5 Claims, 9 Drawing Sheets

DOCTOR BLADE UNIT FOR THE INKING SYSTEM OF A ROTARY PRINTING PRESS

BACKGROUND OF THE INVENTION

1. Field of the Invention

This invention pertains to a doctor blade unit for the inking system of a rotary printing press. The unit includes a doctor blade carrier that is formed by a profiled rail with a channel-shaped recess. On the carrier, two doctor blades that can be screwed down on an ink application roller or screen roller are fastened parallel to one another in the approximate shape of a roof. The doctor blades delimit an ink chamber in cooperation with the ink application roller. The doctor blades also a channel-shaped recess of the doctor blade carrier and sealing elements which are provided on the ends of the doctor blade carrier. Ducts are used for supplying and discharging inks into and from the ink chamber. A spraying device with spraying nozzles is used for spraying a cleaning fluid into the ink chamber. Adjusting equipment is provided for pressing the doctor blade carrier against the ink application roller.

2. Description of Related Art

An ink chamber doctor blade unit of this type is known from U.S. Pat. No. 5,410,961. In this case, a channel system with additional holes that lead to the spraying nozzles is arranged in the profiled rail that forms the rear wall of the ink chamber. The manufacture of this known doctor blade unit is relatively expensive, because it is quite complicated to provide the profiled rail with an interior channel and distribution system for the cleaning fluid which is connected to the individual spraying nozzles.

Consequently, the present invention is based on the objective of disclosing a doctor blade unit of the initially mentioned type which can be manufactured in a less expensive fashion.

SUMMARY OF THE INVENTION

According to the invention, this objective is attained due to the fact that the face walls on the ends of the ink chamber which carry the sealing elements are provided with holes, that the holes accommodate a pipe that is provided with spaced apart holes that form the spraying nozzles over its entire length, and that one end of this pipe is provided with a connection for supplying the cleaning fluid.

Due to the fact that the pipe with the spraying nozzles is arranged in the holes of the lateral walls of the ink chamber, the doctor blade unit according to the invention can be very easily equipped with a spraying device for carrying out a cleaning process after an ink application is completed or if the printing ink is changed. In addition, these holes can be produced after the rotary printing press is manufactured and, therefore, it is easy to retrofit existing doctor blade units with the aforementioned pipe that comprises the spraying nozzles.

Naturally, the end of the pipe which is situated opposite the connection for supplying the cleaning fluid needs to be closed. This can be easily attained by realizing one hole of one side wall in the form of a blind hole that closes one end of the pipe.

According to one additional development, it is proposed to arrange two radial spanning members that form lateral secondary chambers in the ink chamber, wherein the face edges of the spanning members delimit choke gaps in cooperation with the ink application roller, wherein the spanning members are provided with aligned holes for accommodating a pipe that is provided with spaced apart holes that form the spraying nozzles over its entire length, and wherein one end of this pipe is provided with a connection for supplying the cleaning fluid.

A doctor blade unit in which spanning members that serve as dams form lateral secondary chambers can be used. The spanning members that form the dams can be advantageously used for holding a pipe that is provided with the spraying nozzles.

In one additional embodiment of the doctor blade unit according to the invention, it is proposed that an insert that accommodates a pipe can be inserted into the recess. The pipe is provided with spaced apart holes that form the spraying nozzles over its entire length, and one end of the pipe is provided with a connection for supplying the cleaning fluid. This insert can be easily and rapidly inserted into the channel-shaped recess of the doctor blade carrier without having to provide the profiled rail that forms the doctor blade carrier with a special channel system.

According to one advantageous embodiment of the invention, it is proposed that the insert be provided with two radial spanning members that form lateral secondary chambers. The face edges of the spanning members delimit choke gaps in cooperation with the ink application roller, and the spanning members are provided with aligned holes for accommodating the pipe that is provided with the spraying nozzles.

In one other embodiment of the doctor blade unit according to the invention, it is proposed that an insert with a hole that extends parallel to the axis of the ink application roller can be inserted into the recess. The parallel hole is provided with lateral holes that form the spraying nozzles. In this particular embodiment, the insert simply needs to be inserted into the channel-shaped recess of the doctor blade carrier in order to realize the desired arrangement of spraying nozzles. In addition, this embodiment also makes it possible to retrofit existing doctor blade units with spraying nozzles.

It is practical if this insert is also provided with two radial spanning members, the face edges of which delimit choke gaps in cooperation with the ink application roller.

According to one additional development of the invention, it is proposed to provide the insert with a bead that extends parallel to the axis of the ink application roller and delimits a narrow gap in cooperation with the ink application roller. This bead also forms an auxiliary doctor blade that prevents ghost images.

The holes that form the spraying nozzles are preferably arranged in the form of two parallel rows so that they are essentially directed toward the doctor blades and, in particular, rinse the corners of the ink chamber once cleaning fluid is introduced under pressure.

The inserts preferably consist of plastic.

BRIEF DESCRIPTION OF THE DRAWINGS

Embodiments of the invention are described in detail below with reference to the figures.

DESCRIPTION OF THE PREFERRED EMBODIMENTS

Figure 1:
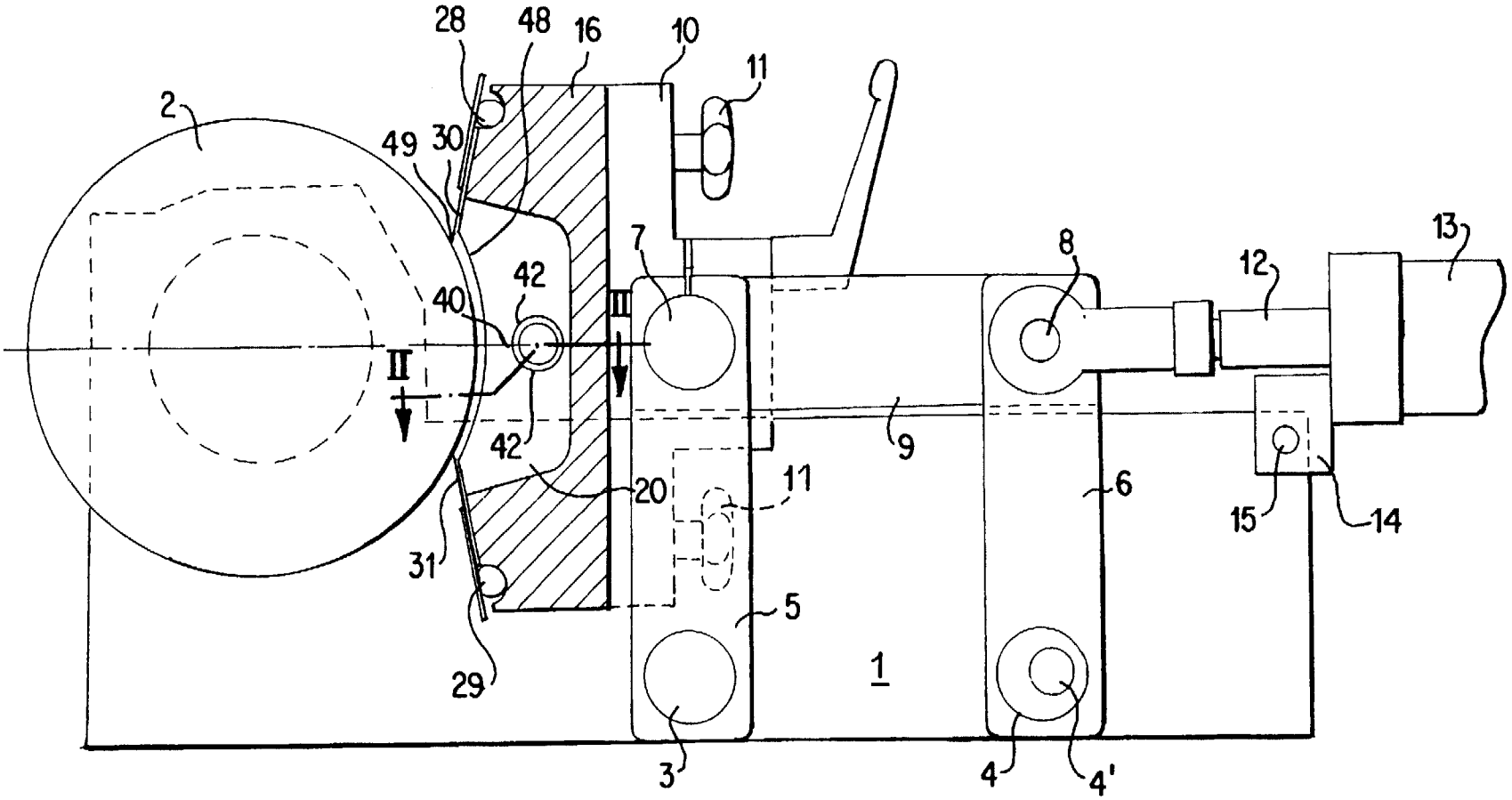
FIG. 1 is a side view of the inking system frame with an ink chamber doctor blade unit that is sectioned along line I—I in FIG. 2.

One side of a screen roller 2 is arranged in the customary fashion in the inking system frame 1 that is usually arranged in a movable fashion on the pressure cylinder frame that is also realized in the form of a slide. This generally known arrangement is not described in detail.

Parallel connecting rods 5,6 are arranged on the inking system frame 1 such that they can be pivoted around the articulated axles 3,4. The upper ends of the parallel connecting rods 5,6 are connected to the carrier 9 that forms a coupler such that they can be pivoted around the articulated axles 7,8. The carrier 9 is realized integrally with the doctor blade unit carrier 10. The doctor blade unit carrier 10 is connected to the doctor blade carrier 16 via screws that are provided with handwheels 11.

The piston rod 12 of a pneumatic cylinder 13 is connected in an articulated fashion to the carrier 9 or the upper ends of the parallel connecting rods 6 in the articulated axle 8, with the pneumatic cylinder being coupled to the inking system frame 1 by a carrying element 14 and the joint 15.

When moving the doctor blades toward the screen roller and away from the screen roller, the coupler 9 and the doctor blade carrier 16 remain parallel because the parallel connecting rods 5,6 have the same length and maintain their parallelism during the pivoting movement.

The articulated axles 4 of the parallel connecting rods 6 are provided with a cam adjustment 4' that makes it possible to raise and lower the pivoting axis of the parallel connecting rod 6.

The parallel connecting rods 5,6 of each of the two inking system frames that carry the screen roller 2 can be realized in the form of double connecting rods in order to increase the stability.

Figure 3:
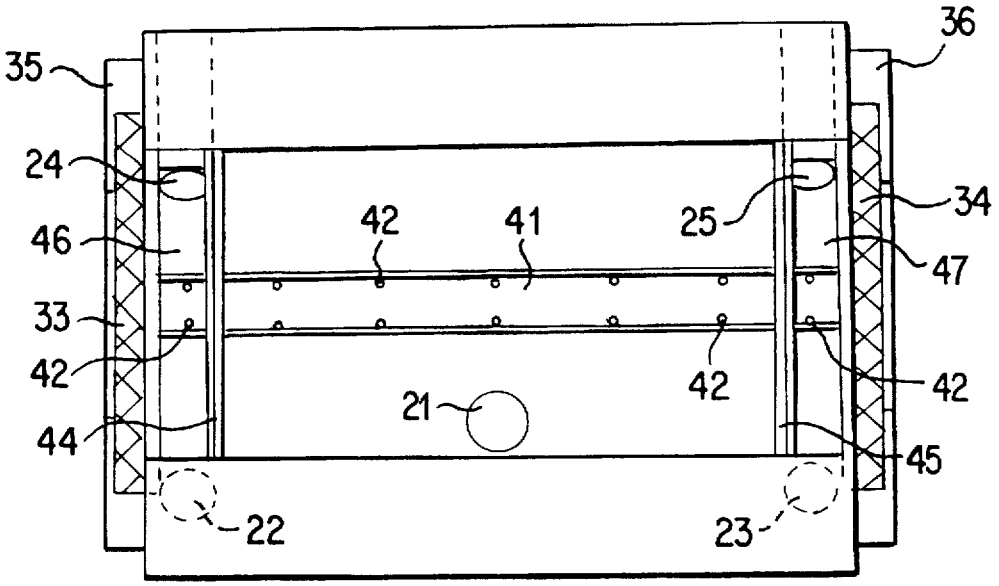
FIG. 3 is a view of the ink chamber doctor blade unit in the direction of arrow III in FIG. 2.

The doctor blade carrier 16 consists of a profiled rail, the profile of which is shown in FIG. 1. The rail of the doctor blade carrier 16 is provided with a channel 20 that forms the interior of the ink chamber. A hole 21 for supplying the printing ink ends in this channel, namely within the lower central region as shown in FIG. 3. Holes 22,23 that serve for discharging the printing ink are cut into the lower end regions of the aforementioned channel. Ventilation holes 24,25 end within the upper end regions of this channel.

The side surfaces of the channel edges are mutually inclined in the shape of a roof. The doctor blades 30,31 are customarily fastened to these side surfaces with clamping elements 28,29. This generally known arrangement is not described in detail.

Seals 33,34 that seal the interior 20 of the ink chamber relative to the screen roller 2 are arranged on the sides of the doctor blade carrier 16. In order to hold these seals in their respective position, covers 35,36 that form the face walls at the ends of the ink chamber 20 are connected to the lateral side surfaces of the rail of the doctor blade carrier by screws.

The cover 35 is provided with a through-hole and the cover 36 is provided with a flat blind hole, with both holes being arranged symmetric to the central plane 40 of the doctor blade carrier 16. A pipe 41 that essentially extends through the hole in the cover 35 is held in the aforementioned holes. The pipe 41 is provided with two rows of holes 42 that form the spraying nozzles, with the aforementioned two rows being arranged on both sides of the central plane 40 of the doctor blade carrier 16. The holes 42 of each row include an angle of approximately 90°, i.e., the spraying nozzles formed by the holes are directed approximately toward the rear sides of the doctor blades 30,31.

The pipe 41 is arranged at a suitable distance from the base of the channel-shaped recess such that wedge-shaped spaces, from which ink residue is difficult to remove, are prevented.

The ink chamber is provided with lateral spanning members 44,45 that divide the ink chamber into a central main chamber and lateral secondary chambers 46,47. The spanning members have face edges 48 that are rounded in accordance with the radius of the screen roller 2 and delimit choke gaps 49 in cooperation with the screen roller 2. The spanning members 44,45 are provided with apertures so that the ink can flow from the main chamber to the secondary chambers 46,47.

The spanning members that form the secondary chambers serve as dams.

The spanning members 44,45 are also provided with aligned holes that are arranged symmetrically with respect to the central plane 40 of the doctor blade carrier 16. The pipe 41 extends through these aligned holes. The aligned holes of both spanning members 44,45 can also be used for holding the spraying nozzle pipe 41.

Figure 2:
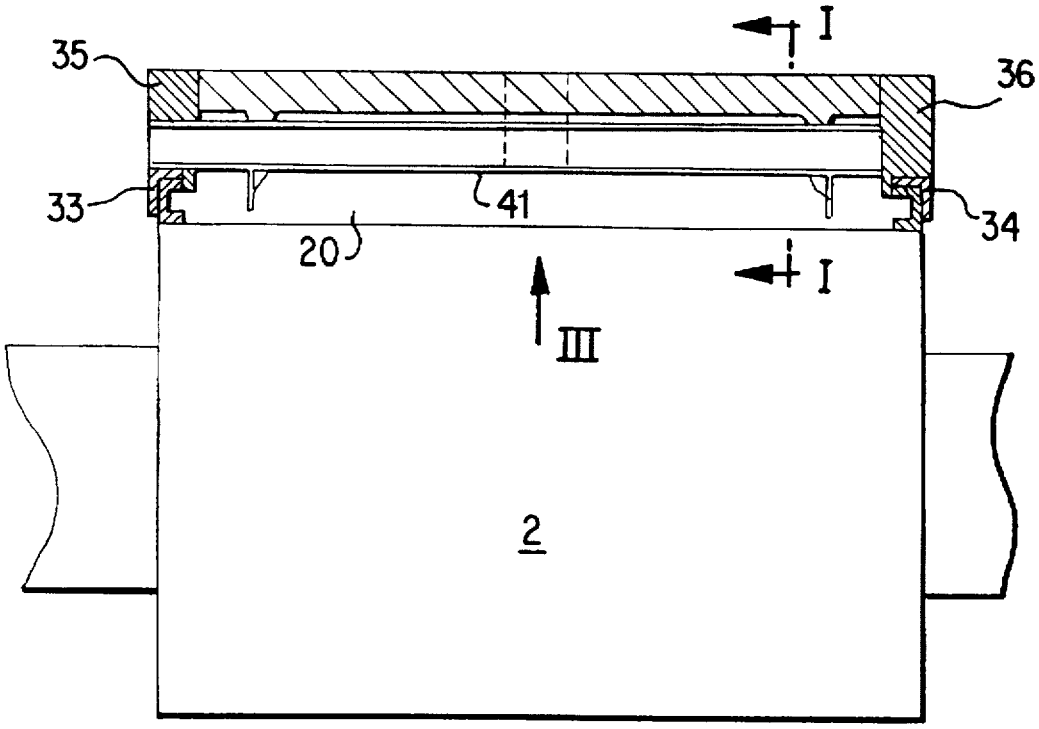
FIG. 2 is a section through the doctor blade carrier along line II—II in FIG. 1.
Figure 4:
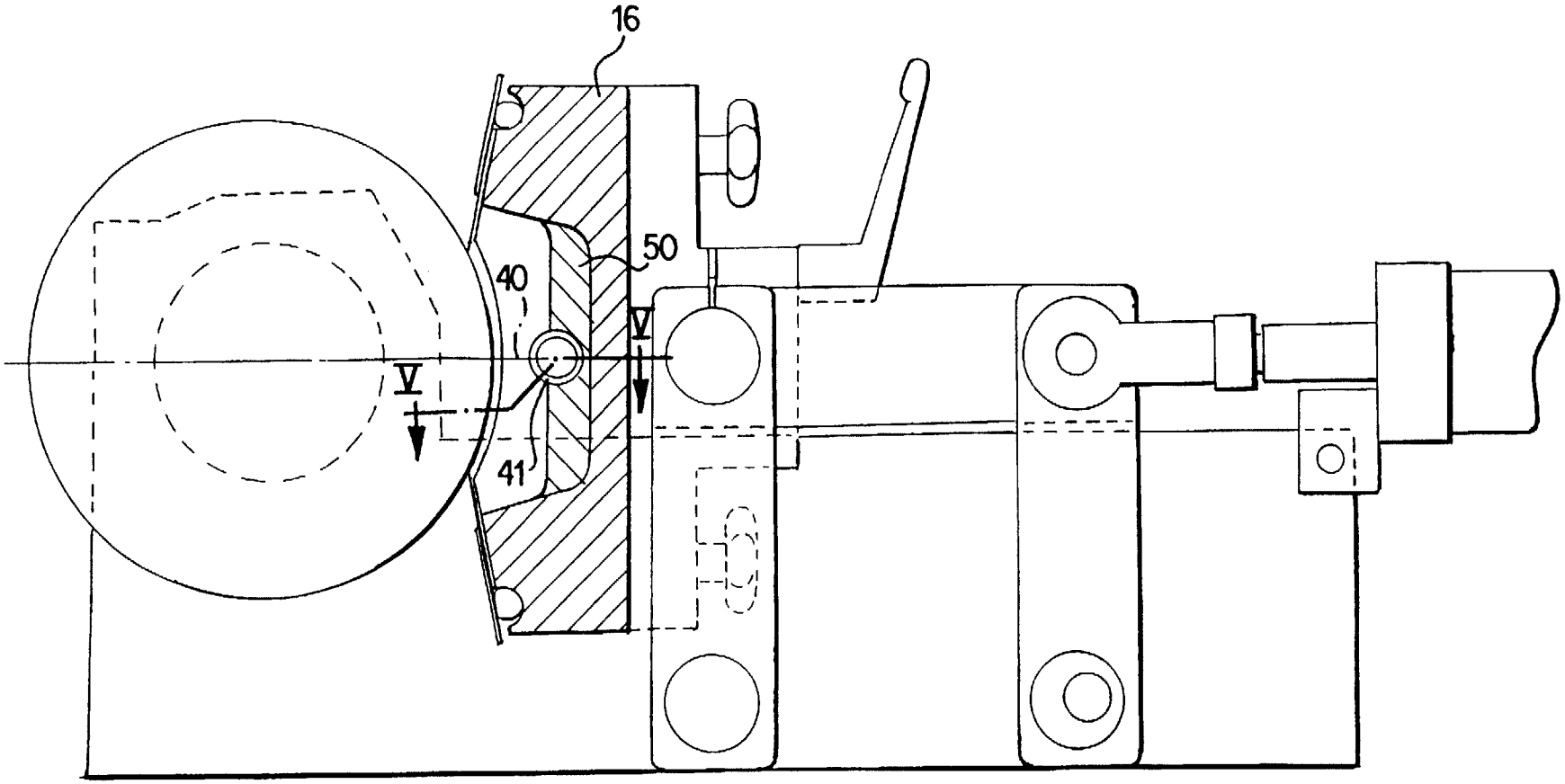
FIGS. 4–6 show a second embodiment of a doctor blade unit in which the respective views correspond to those shown in FIGS. 1–3.
Figure 5:
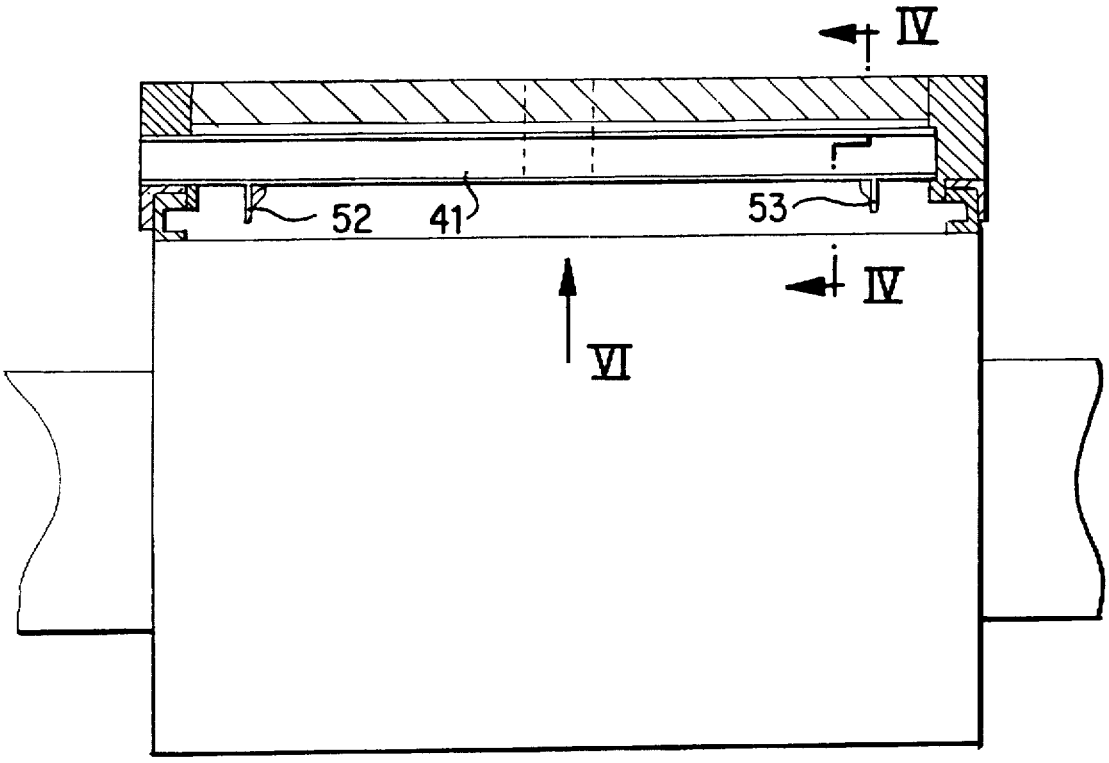
Figure 6:
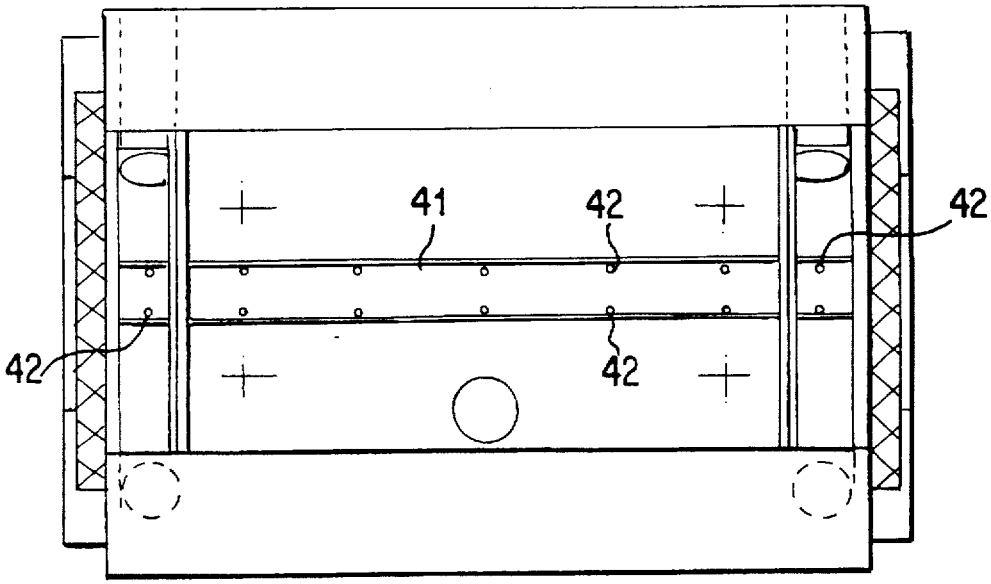

The embodiment of the doctor blade unit according to FIGS. 4–6 essentially only differs from that shown in FIGS. 1–3 in that a plastic insert 50 is inserted and fastened in the recess 20 that forms the ink chamber as shown in the figures. This insert is provided with a hole that is cut into the upper side of the insert in the central plane 40 of the doctor blade carrier 16. The spraying nozzle pipe 41 is inserted or held in this hole. Within the end regions of the interior of the ink chamber, the insert 50 is also provided with radial spanning members 52,53 that form lateral secondary chambers. These spanning members 52,53 are provided with aligned holes, through which the spraying nozzle pipe 41 extends. The spraying nozzle pipe 41 is provided with holes 42 that form spraying nozzles to both sides of the central plane 40, namely in the same fashion as the spraying nozzle pipe according to FIGS. 1–3. In all embodiments, these holes are also arranged in the secondary chambers formed by the spanning members.

Figure 7:
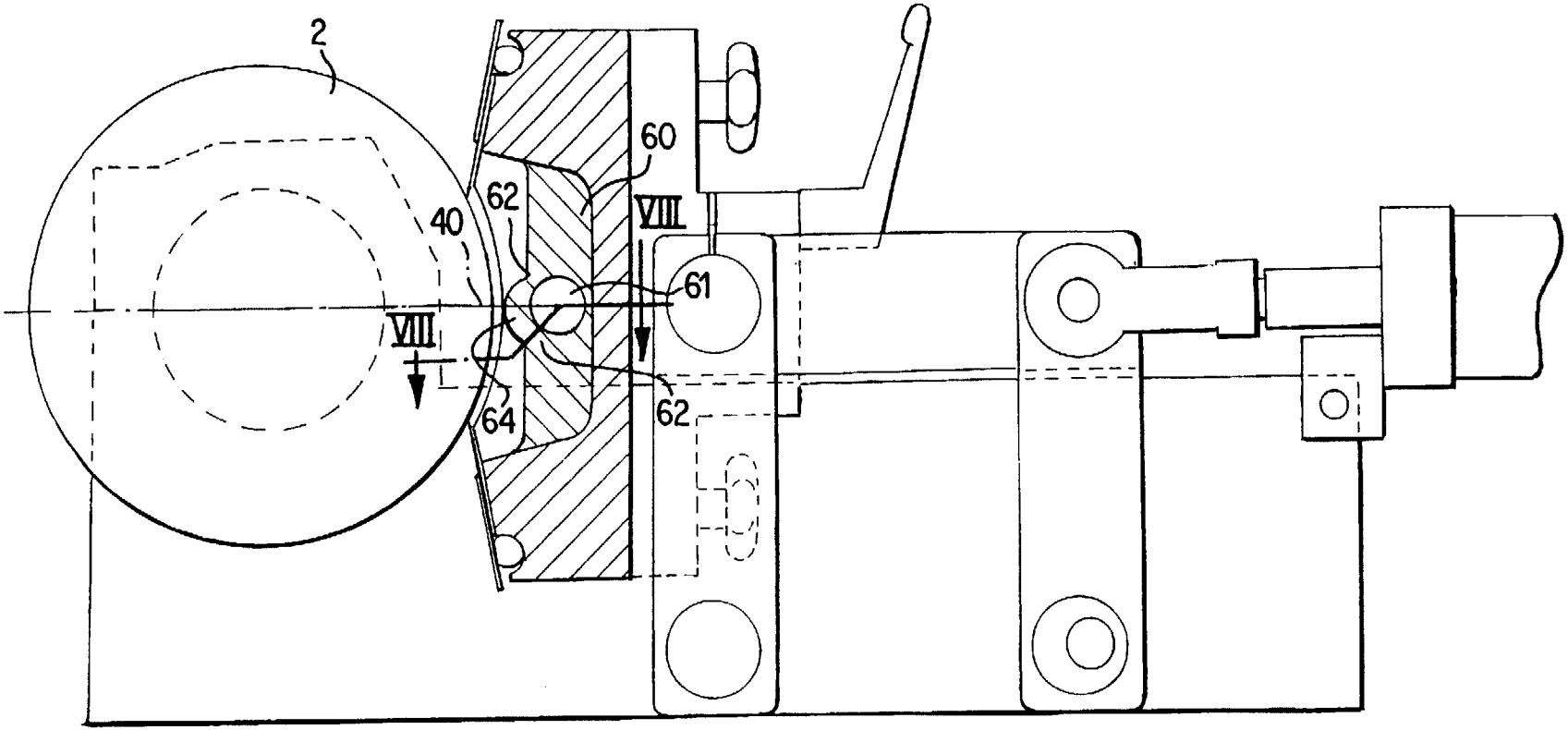
FIGS. 7–9 show a third embodiment of a doctor blade unit in which the respective views correspond to those shown in FIGS. 1–3.
Figure 8:
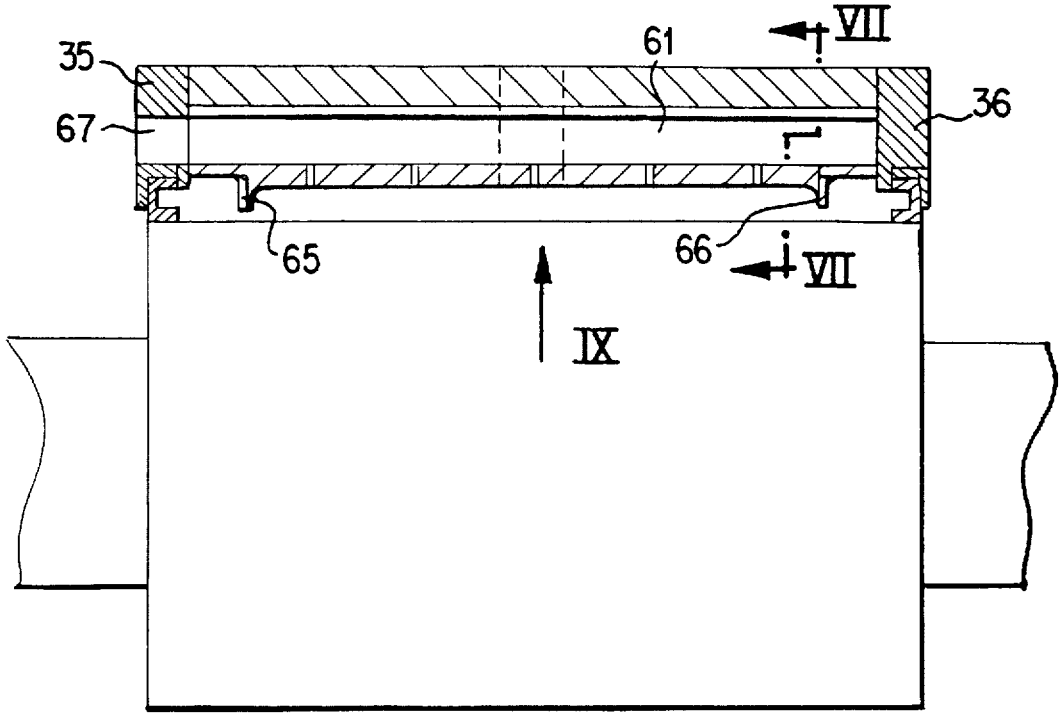
Figure 9:
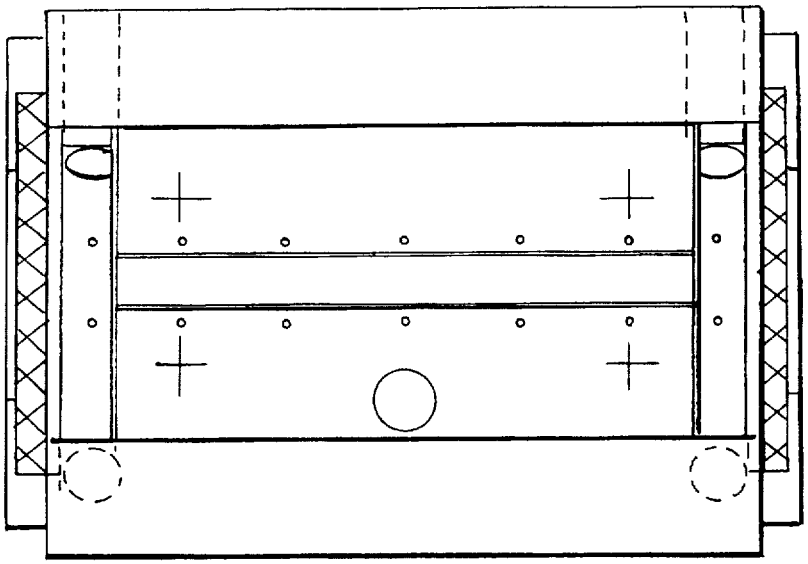

The embodiment according to FIGS. 7–9 differs from that shown in FIGS. 4–6 due to the fact that the insert 60 of plastic is not provided with an inserted spraying nozzle pipe, but rather a hole 61 that extends in parallel with the axis of the screen roller 2. The hole 61 is provided with lateral holes 62 that form the spraying nozzles to both sides of the central plane 40, with the lateral holes including an angle of approximately 90° and being directed toward the rear sides of the doctor blades.

In the central plane 40, the insert 60 is provided with a longitudinally extending bead 64 that forms a gap in cooperation with the screen roller 2 and serves to prevent ghost images.

The insert 60 is also provided with spanning members 65,66 that form the lateral secondary chambers.

The hole 61 is closed by the cover 36 on its right side as shown in FIG. 8. On the left side, the hole 61 is arranged aligned with a hole 67 of the cover 35.

The hole 67 or the end of the spraying nozzle pipe 41 that extends through the hole in the cover 35 is provided with a connection for supplying a cleaning fluid.

During the cleaning cycle, the cleaning fluid is discharged into the secondary chambers via the holes 22,23.

Special spraying heads that are provided with devices that prevent the admission of ink can be additionally inserted into the holes that form the individual spraying nozzles.

What is claimed is:

1. A combination of a screen roller and a doctor blade unit for an inking system of a rotary printing press, comprising:

a doctor blade carrier that is formed of a profiled rail with a channel-shaped recess;

two doctor blades fastened to said doctor blade carrier and disposed at an angle relative to each other, the doctor blades, in cooperation with the screen roller, enclosing the channel-shaped recess and delimiting an ink chamber;

sealing elements provided on ends of the doctor blade carrier and sealing off said ink chamber, said doctor blade carrier including holes therein for supplying and discharging ink into and from the ink chamber;

an insert with a hole that extends parallel to an axis of the roller inserted into the recess, the hole that extends parallel to the axis interconnecting with lateral holes in the insert that form spraying nozzles for spraying a cleaning fluid into the ink chamber;

a piston and cylinder device for pressing the doctor blade carrier against the screen roller; and covers on ends of the ink chamber which carry the sealing elements and accommodate said insert, one of said covers including a hole communicating with one end of said hole that extends parallel to an axis of the roller for supplying cleaning fluid.

2. A doctor blade unit according to claim 1, wherein the insert is provided with two radial spanning members having face edges which delimit choke gaps in cooperation with the roller.

3. A doctor blade unit to claim 1, wherein the insert is provided with a bead that extends in parallel with the axis of the roller and delimits a narrow gap in cooperation with the roller.

4. A doctor blade unit according to claim 1, wherein the insert is made of plastic.

5. A doctor blade unit to claim 2, wherein the insert is provided with a bead that extends in parallel with the axis of the roller and delimits a narrow gap in cooperation with the roller.

* * * * *